US007036250B2

(12) United States Patent
Dressler et al.

(10) Patent No.: US 7,036,250 B2
(45) Date of Patent: May 2, 2006

(54) LATCHLESS CONTROLLER TOWER

(75) Inventors: Robert Paul Dressler, Lancaster, WI (US); James Gerard Merten, Dubuque, IA (US); Robert Joseph Hachmann, Peosta, IA (US)

(73) Assignee: Deere & Company, Moline, IL (US)

( * ) Notice: Subject to any disclaimer, the term of this patent is extended or adjusted under 35 U.S.C. 154(b) by 1 day.

(21) Appl. No.: 10/661,342

(22) Filed: Sep. 12, 2003

(65) Prior Publication Data

US 2005/0055852 A1 Mar. 17, 2005

(51) Int. Cl.
*E02F 3/00* (2006.01)

(52) U.S. Cl. ..... 37/466; 74/493; 180/326; 180/334; 180/333

(58) Field of Classification Search ..... 37/443, 37/466, 348; 180/326, 334, 333, 272, 331, 180/332; 74/493; 280/775; 414/699
See application file for complete search history.

(56) References Cited

U.S. PATENT DOCUMENTS

| | | | | |
|---|---|---|---|---|
| 4,140,200 | A * | 2/1979 | Tucek | 180/333 |
| 4,821,837 | A * | 4/1989 | Fifer | 180/334 |
| 5,050,700 | A * | 9/1991 | Kim | 180/268 |
| 5,862,893 | A * | 1/1999 | Volpel | 188/276 |
| 5,921,340 | A * | 7/1999 | Abels | 180/326 |
| 6,101,794 | A * | 8/2000 | Christopherson et al. | 56/6 |
| 6,148,688 | A * | 11/2000 | Nishimaki | 74/493 |
| 6,164,285 | A | 12/2000 | Garberg et al. | |
| 6,352,133 | B1 * | 3/2002 | Ojima | 180/326 |
| 6,464,276 | B1 * | 10/2002 | Gruich | 296/37.6 |
| 6,564,896 | B1 | 5/2003 | Proksch et al. | |

* cited by examiner

*Primary Examiner*—Victor Batson

(57) ABSTRACT

A controller tower positioning system for a work vehicle for securing the controller tower to one of at least two positions. The system employs a mounting bracket fixed to the floor or a frame member of the work vehicle, a movable controller tower rotatably mounted to the mounting bracket and a resistive element strategically mounted to the controller tower and the mounting bracket to provide resistance to movement away from either of the two positions and a toggle effect as the controller tower is moved from one of the two positions to the other. The controller assembly is physically restrained at the free end of the controller tower.

29 Claims, 4 Drawing Sheets

LATCHLESS CONTROLLER TOWER

FIELD OF THE INVENTION

The invention relates to the positioning and operation of controller towers for backhoes. More specifically, it relates to a method, system and apparatus for safely and securely positioning controller towers to allow the operator to easily and conveniently move the traditional swivel seat often associated with backhoe cabs into and out of the backhoe operating position.

BACKGROUND OF THE INVENTION

Backhoes are often equipped with an operator station having a dual position swivel seat which allows the operator to remain seated as he/she pivots between loader and backhoe operations. Such a provision normally requires movable controller towers as controller towers that are properly located for optimum operator convenience and comfort in backhoe operation usually interfere with the operator's legs and/or with the seat as the operator pivots between backhoe and loader functions. The movable controller towers usually have two basic positions: (1) the stow position which allows the operator to move the swivel seat into and out of the backhoe operating position; and (2) the backhoe operating position which allows the operator to comfortably operate the backhoe when the swivel seat is in the backhoe operating position.

Conventional movable controller towers are mounted such that one controller tower is located on each side of the seat, each controller tower being secured in either of the two basic positions via releasable cable and latch mechanisms.

SUMMARY OF THE INVENTION

The inventors recognize that conventional movable controller towers require a significant amount of extra hardware for cable and latch mechanisms as well as extra labor to produce and assemble the hardware. Further, the additional hardware occupies precious portions of limited available space that could be used for other valuable purposes. Finally, the transverse shaft, commonly shared by both controller towers in some conventional systems, is exposed to the detriments of the environment as it is located under the cab floor; it also reduces functionality in the system by requiring simultaneous movement of the towers.

The invention overcomes each of the above mentioned limitations of conventional controller towers via an elegantly simple mechanism. Simple mounting brackets are fixedly attached to portions of the frame or floor on either side of the seat. A shaft, some ball bearings and a snap ring secure each tower to the mounting brackets via a hole in the brackets and serve as a pivot for the independent movement of each tower to each of its positions. A gas filled strut, operatively attached to each tower and corresponding mounting bracket, provides a toggle or over-center effect as each tower is moved from one of its two positions to the other. Thus, an operator may change the position of a tower by pushing or pulling a portion of the tower structure. Adequate extending forces of each strut keeps each of the towers in either of their dual positions, thus eliminating the need for cables and latches to lock the towers. The common rotational shaft, present in some conventional systems, is also eliminated, increasing available space on the underside of the floor for greater access to other components. Finally, the time and cost for parts and labor for each controller tower are reduced.

BRIEF DESCRIPTION OF THE DRAWINGS

Embodiments of the invention will be described in detail, with references to the following figures, wherein.

DETAILED DESCRIPTION

Figure 1:
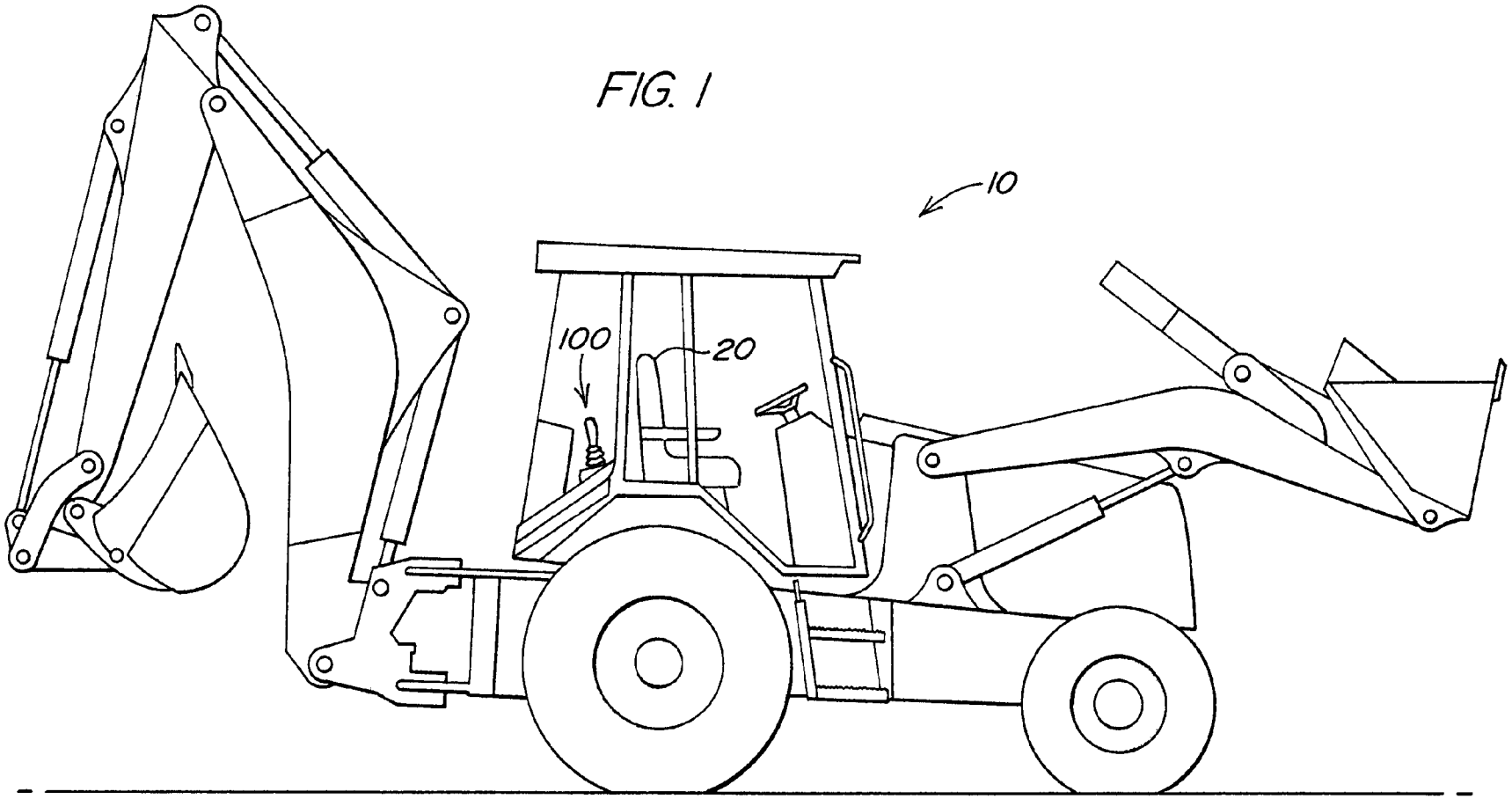
FIG. 1 is a view of a work vehicle in which the invention may be used.

FIG. 1 illustrates a work vehicle 10 in which the invention may be used. The particular work vehicle illustrated in FIG. 1 is a loader backhoe with a single multiple position swivel seat 20. The multiple positions of the swivel seat 20 include at least a loader operating position and a backhoe operating position and are usually angularly spaced 180° apart. In FIG. 1, the swivel seat 20 is shown in the loader operating position. The work vehicle also has two backhoe control assemblies 100.

Figure 3:
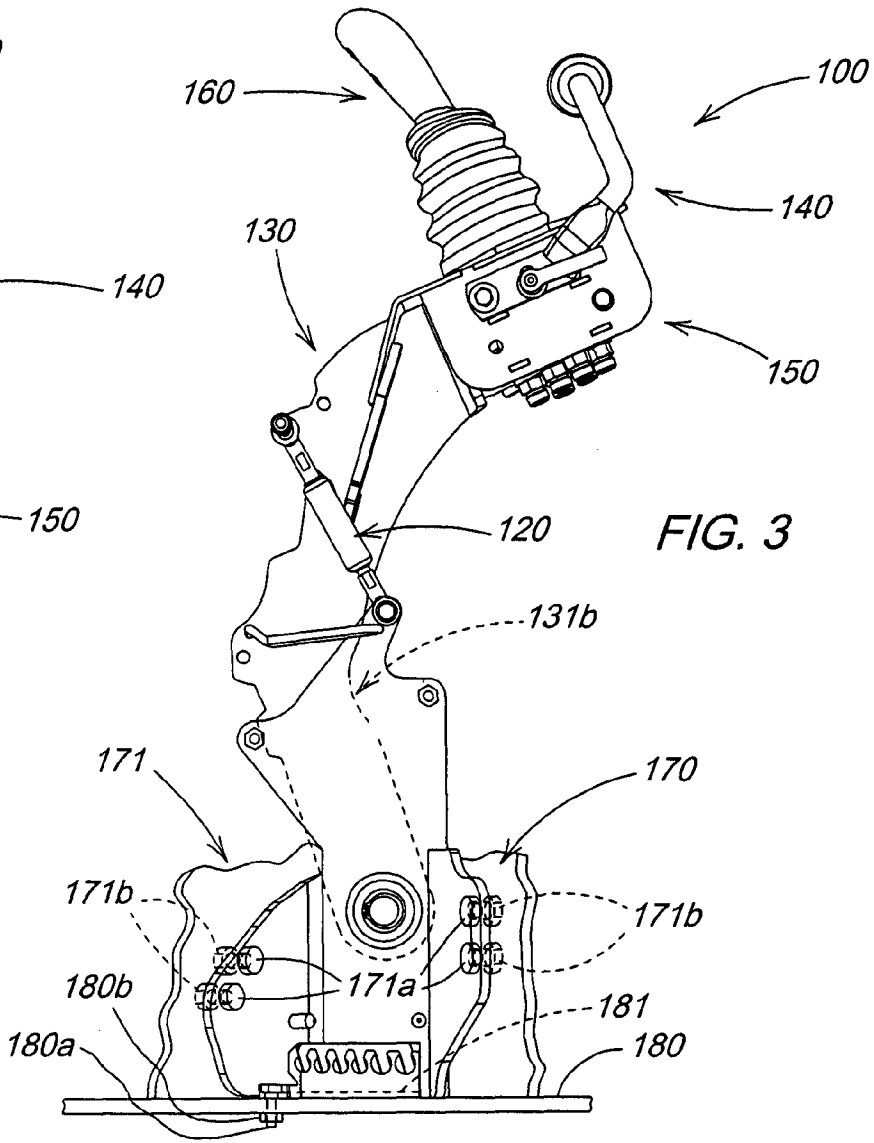
FIG. 3 is a side view of the invention in a stow position, i.e., the invention is positioned to allow a change in seat position.
Figure 2:
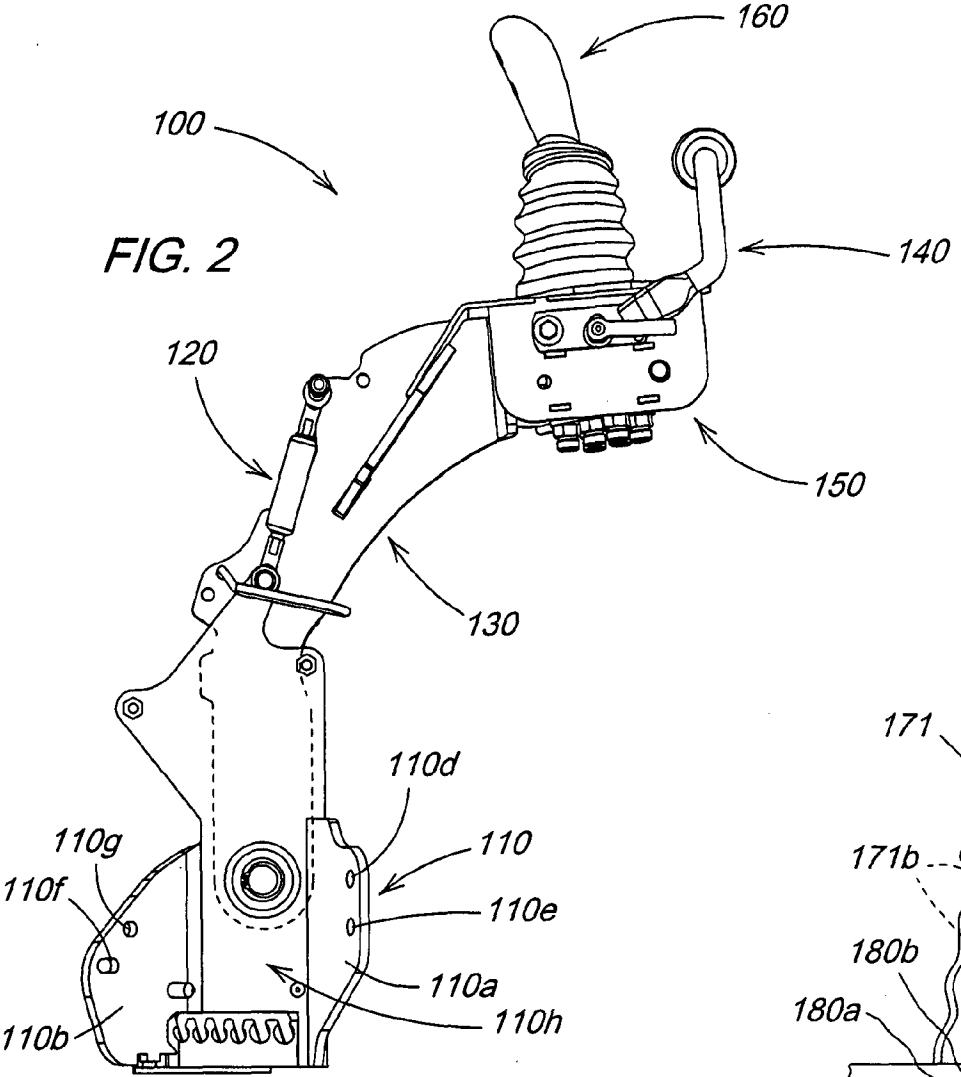
FIG. 2 is a side view of the invention in an operating position.

FIG. 2 illustrates an exemplary embodiment of a backhoe control assembly 100 in the backhoe operating position according to the invention. FIG. 3 shows the same backhoe control assembly 100 in the stow position. The particular control assembly 100 illustrated is located on the left side of the seat when the seat is in the backhoe operating position. Only this control assembly 100 will be described as its working parts are identical to those of the other control assembly (not shown) on the left side of the seat. The control assembly 100 includes a mounting bracket 110, a strut assembly 120 operatively attached to the mounting bracket, a movable controller tower 130 operatively attached to the mounting bracket 110 and the strut assembly 120, a pilot controller assembly 160 and an armrest assembly 140.

The mounting bracket 110 includes a first mounting side 110*a* containing mounting holes 110*d* and 110*e*; a second mounting side 110*b* containing mounting holes 110*f* and 110*g*; and center portion 110*h*, including two controller tower stop assemblies 114 and 115, a hole 112 for attaching the strut assembly 120 to the mounting bracket 110, and a race 110*c* for pivotally attaching the controller tower 130 to the mounting bracket 110. The mounting bracket 110 is securely attached to left frame members 170 and 171 as well as the cab floor 180 via mounting holes 110*d*, 110*e*, 110*f* and 110*g* by means well known in the art. See FIG. 3 for one exemplary method of attachment in which the mounting bracket 110 is attached to right frame members 170 and 171 via bolts 171*a* and nuts 171*b* and to the floor via bolt 180*a*, nut 180*b* and via a tab 181 welded to the mounting bracket 110. Each of the stops 114 and 115 include a bolt 111*a*, a spacer 11*b* and a nut 111*c*.

The strut assembly 120 includes a conventional gas filled strut 121 having a first end 121*a* and a second end 121*b*. The first and second ends 121*a*, 121*b* are constructed for attachment to working structures in manners well known in the art via eyelets 122, each eyelet having three dimensional rotation characteristics.

The movable controller tower 130 includes a mounting plate 131 having two square positioning holes 133 for positioning a first stiffening rib 137*a* and a square hole 136 for positioning rotationally fixed screw 126. Attached to the mounting plate, via welding are a hose harness 137*a*, a second stiffening rib 137*b*, a third stiffening rib 137*c*, a pivot shaft 134 and a controller cage 150. The stiffening ribs 137*a*, 137*b* and 137*c* are positioned as shown in FIGS. 1, 2, 3, and 4 and welded to the mounting plate by means well known in the art. The controller cage 150 houses the pilot controller assembly 160 and restricts/constrains all movement of the pilot controller assembly 160 as a whole via methods and structures well known in the art.

The armrest assembly 140 includes a strong and rigid support arm 142 having a pivot hole 144 and an adjustment hole 143. The support arm 142 may be constructed of a metal such as steel. The armrest assembly 140 also includes a soft surface mounted to the support arm 142. The soft surface may be provided by a padded roller 141 rotationally mounted to the support arm 142 as in the embodiment described and illustrated herein (see FIG. 4) or a conventional soft surface mounted via a suitable means already known in the art. The support arm 142 is pivotally mounted to the controller cage via a bolt 146, a spacer 148, the pivot hole 151*a* in a side plate 151 of the controller cage 150 and a nut (not shown). The armrest 140 is rotationally constrained by a screw 149, a slotted hole 144 and a nut arm 145. The armrest 140 may be rigidly held in place and prevented from rotating about bolt 146 by sufficiently tightening the nut arm 145. Additionally, the rotational position of the support arm 142 may be adjusted along the length of the adjustment hole 143 by loosening the nut arm 145 sufficiently to allow movement.

Figure 4:
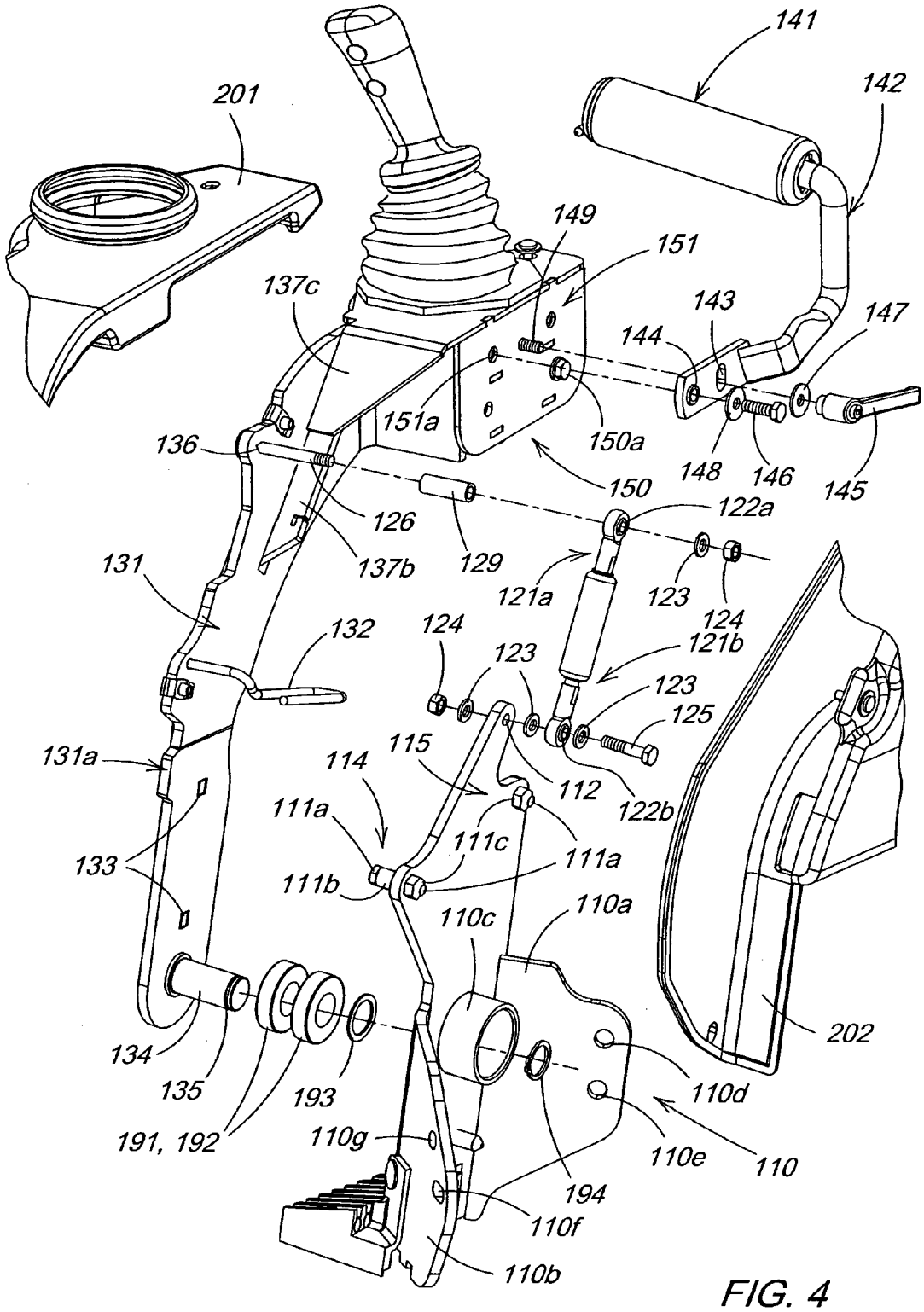
FIG. 4 is an oblique view of the invention.
Figure 5:
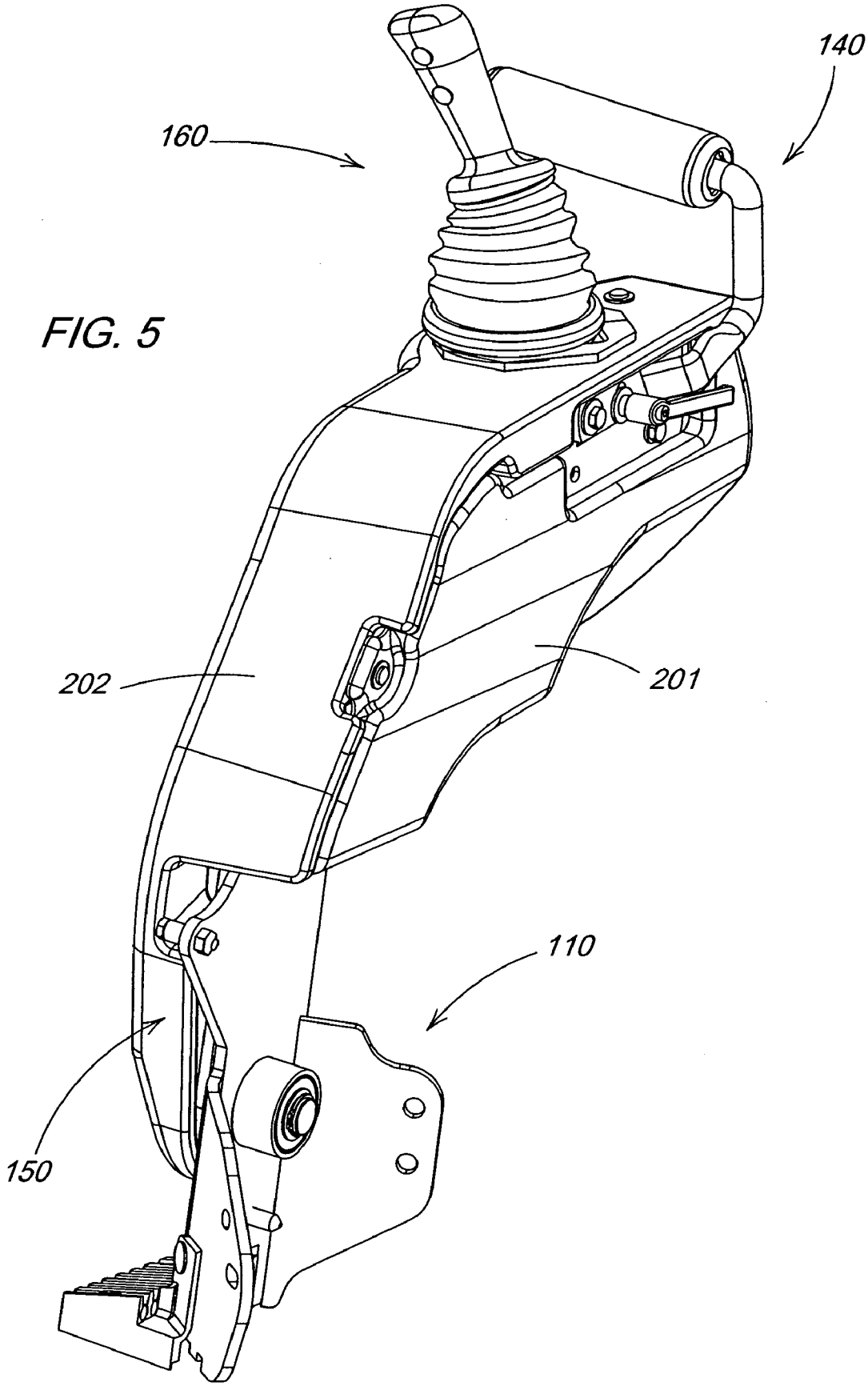
FIG. 5 is an exploded view of the invention.

The mounting plate 131 is operatively attached to the first end 121*a* of the gas filled strut 121 via the square hole 136, the screw 126, the spacer 129, the eyelet 122*a*, a spacer 123 and the nut 124. The second end 121*b* of the gas filled strut 121 is attached to the mounting bracket 110 via nut 124, bolt 125, hole 112, eyelet 122*b* and three spacers 123, 123, 123 as shown in FIG. 4. Thus, the movable controller tower 130 is operatively connected to the mounting bracket 110 via the gas filled strut 120.

The mounting plate is rotationally attached to the mounting bracket 110 via the pivot shaft 134, ball bearings 191, 192, a spacer 193, a snap ring 194 and the race 110*c*. During assembly of the mounting plate 131 to the mounting bracket 110, ball bearings 191 and 192 press fit into the hole provided by the race 110*c*. The pivot shaft 134 is then slip fitted into the ball bearings 191 and 192, the spacer 193 is fitted over the pivot shaft 134 and, finally, the snap ring 194 is assembled to the pivot shaft 134 via shaft groove 135. Thus, movement of the mounting plate 131 at the pivot shaft 134 is constrained by the mounting bracket 110 in all directions excepting a rotational motion about an axis of the pivot shaft 134.

The gas filled strut 120 is compressive and is assembled to the controller tower 130 and the mounting bracket 110 such that it is shortest at an intermediate position between the stow and backhoe operating positions of the controller tower 130 (see FIGS. 2 and 3). Thus, the gas filled strut 120 acts as a toggle mechanism which resists motion of the controller tower 130 from a first or a second position toward the intermediate position and enhances motion of the controller tower 130 from the intermediate position toward the first or the second position. Although the load applied by the gas filled strut 120 increases with decreases in its overall length, the portion of the load applied to resist movement of the controller tower 130 decreases as the angle of the strut axis approaches 90° with respect to the mounting bracket base 113. As a result of this arrangement, resistance to any motion of the controller tower 130 toward the intermediate position is highest at the stow and backhoe operating positions. Resistance to movement of the controller tower 130 toward the intermediate position tends to decrease as the distance between the position of the controller tower 130 and the intermediate position decreases. The gas filled strut 120 acts to push the controller tower 130 away from the intermediate position with a force that is proportional to the distance of the controller tower 130 from the intermediate position.

Resistance to movement from the stow position or the backhoe operating position is sufficient to keep the controller tower 130 in that position. The application force required to overcome the resistance may be preset at a minimum of, for example, 20 pounds.

The stops 114 and 115 define each of the rotational limits for movement, i.e., the stow position and the operating position, respectively, for the controller tower 130. In the stow position, surface 131*a* contacts the stop 114 and prevents further movement of the controller tower 130 away from the intermediate position. In the operating position, the surface 131*b* contacts the stop 115 preventing further movement of the controller tower 130 away from the intermediate position.

Having described the illustrated embodiment, it will become apparent that various modifications can be made without departing from the scope of the invention as defined in the accompanying claims.

The invention claimed is:

1. A latchless controller positioning system for a work vehicle, the work vehicle having a floor, the controller positioning system comprising:

a mounting bracket having a first mounting bracket end and a second mounting bracket end, the first mounting bracket end attached to the floor;

a controller tower, capable of moving to a first position and a second position, the controller tower having a first controller tower end and a second controller tower end, the first controller tower end pivotally mounted to the mounting bracket;

a controller assembly physically constrained at the second controller tower end; and a resistive element having a first element end and a second element end, the resistive element being strategically mounted to the controller tower and the mounting bracket to provide resistance to a movement of the controller tower and a toggle effect as the controller tower is moved between the first position and the second position.

2. The latchless controller positioning system of claim 1, wherein the resistive element is a compressive element.

3. The latchless controller positioning system of claim 2, wherein the controller tower moves through an intermediate position as it moves between the first position and the second position, the compressive element providing substantially no resistance to the movement of the controller tower at the intermediate position, the compressive element biasing the controller tower toward a direction of movement as the controller tower moves beyond the intermediate position.

4. The latchless controller positioning system of claim 2, wherein the compressive element is a strut.

5. The latchless controller positioning system of claim 2, wherein the compressive element is a gas filled strut.

6. The latchless controller positioning system of claim 1, further comprising an armrest at the second controller tower end.

7. The latchless controller positioning system of claim 6, wherein a height of the armrest is adjustable.

8. The latchless controller positioning system of claim 1, wherein the work vehicle is a loader backhoe.

9. The latchless controller positioning system of claim 8, wherein the first position is a stow position and the second position is an operating position.

10. The latchless controller positioning system of claim 1, wherein the first element end is mounted to the mounting bracket and the second element end is operatively attached to the controller tower.

11. A work vehicle having a frame, a floor and a controller positioning system, the controller positioning system comprising:

a mounting bracket having a first mounting bracket end and a second mounting bracket end, the first mounting bracket end attached to the floor;

a controller tower, capable of moving to a first position and a second position, the controller tower having a first controller tower end and a second controller tower end, the first controller tower end pivotally mounted to the second mounting bracket end;

a controller assembly physically constrained at the second controller tower end; and a resistive element having a first element end and a second element end, the resistive element being strategically mounted to the controller tower to provide a toggle effect as the controller tower is moved between the first position and the second position.

12. The work vehicle of claim 11, wherein the resistive element is a compressive element.

13. The work vehicle of claim 12, wherein the controller tower moves through an intermediate position as it moves between the first position and the second position, the compressive element providing substantially no resistance to the movement of the controller tower at the intermediate position, the compressive element biasing the controller tower toward a direction of movement as the controller tower moves beyond the intermediate position.

14. The work vehicle of claim 12, wherein the compressive element is a strut.

15. The work vehicle of claim 12, wherein the compressive element is a gas filled strut.

16. The work vehicle of claim 11, further comprising an armrest at the second controller tower end.

17. The work vehicle of claim 16, wherein a height of the armrest is adjustable.

18. The work vehicle of claim 11, wherein the work vehicle is a loader backhoe.

19. The work vehicle of claim 18, wherein the first position is a stow position and the second position is an operating position.

20. The work vehicle of claim 11, wherein the first element end is mounted to the mounting bracket and the second element end is operatively attached to the controller tower.

21. A method of positioning a controller for a work vehicle, the work vehicle having a dual position swivel seat capable of moving between a first swivel seat position and a second swivel seat position, a frame, a floor and a controller positioning system, the controller positioning system comprising a mounting bracket having a first mounting bracket end and a second mounting bracket end, the first mounting bracket end rigidly attached to the floor; a controller tower, the controller tower capable of moving to a first controller tower position and a second controller tower position, the controller tower having a first controller tower end and a second controller tower end, the first controller tower end pivotally mounted to the mounting bracket; a controller attached to the second controller tower end, an armrest attached to the second controller tower end; and a resistive element having a first element end and a second element end, the resistive element strategically mounted to the controller tower and the mounting bracket to provide a toggle effect as the controller tower is moved between the first position and the second position, the resistive element providing a resistance to a movement of the controller tower, the method including:

applying a directional load to the controller tower from one of the first controller tower position and the second controller tower position toward another of the first controller tower position and the second controller tower position, the directional load being sufficient to overcome the resistance from the resistive element and to move the controller tower toward the other of the first controller tower position and the second controller tower position;

maintaining the directional load until the resistive element biases the controller tower toward the other one of the first controller tower position and the second controller tower position.

22. The method of claim 21, wherein the resistance from the resistive element to a movement away from the one of the first controller tower position and the second controller tower position decreases between the one of the first controller tower position and the second controller tower position and an intermediate position located between the first controller tower position and the second controller tower position and, wherein the resistive element biases a movement away from the intermediate position toward either the first controller tower position or the second controller tower position as the controller tower at the first position and the second position.

23. The method of claim 21, wherein the controller tower moves through an intermediate position as it moves between the first position and the second position, the resistive element providing substantially no resistance to the movement of the controller tower at the intermediate position, the resistive element providing the greatest resistance to movement of the controller tower at the first position and the second position.

24. The method of claim 21, wherein the first position is a stow position and the second position is an operating position.

25. A method of positioning a controller assembly for a work vehicle, the work vehicle having a dual position swivel seat capable of moving between a first swivel seat position and a second swivel seat position, a frame, a floor and a controller positioning system, the controller positioning system comprising a mounting bracket having a first mounting bracket end and a second mounting bracket end, the first mounting bracket end rigidly attached to the floor; a controller tower, the controller tower capable of moving to a first controller tower position and a second controller tower position, the controller tower having a first controller tower end and a second controller tower end, the first controller tower end pivotally mounted to the mounting bracket; a controller attached to the second controller tower end, an armrest attached to the second controller tower end; and a strut having a first strut end and a second strut end, the strut strategically mounted to the controller tower to provide a toggle effect as the controller tower is moved between the first position and the second position, the strut providing a resistance to a movement of the controller tower, the method including:

applying a directional load to the armrest and toward one of the first controller tower position and the second controller tower position, the directional load being sufficient to overcome the resistance from the strut and to move the controller tower toward the one of the first controller tower position and the second controller tower position; and maintaining the directional load until the controller tower moves to the one of the first controller tower position and the second controller tower position.

26. A latchless controller positioning system for a work vehicle, the work vehicle having a floor, the controller positioning system comprising:

a mounting bracket having a first mounting bracket end and a second mounting bracket end, the first mounting bracket end attached to the floor;

a controller tower, capable of moving to a first position and a second position, the controller tower having a first controller tower end and a second controller tower end, the first controller tower end pivotally mounted to the mounting bracket;

a controller assembly physically constrained at the second controller tower end; and a resistive element having a first element end and a second element end, the resistive element being strategically mounted to the controller tower and the mounting bracket to provide resistance to a movement of the controller tower and a toggle effect as the controller tower is moved between the first position and the second position, wherein the resistive element is a compressive element and wherein the controller tower moves through an intermediate position as it moves between the first position and the second position, the compressive element providing substantially no resistance to the movement of the controller tower at the intermediate position.

27. A work vehicle having a frame, a floor and a controller positioning system, the controller positioning system comprising:

a mounting bracket having a first mounting bracket end and a second mounting bracket end, the first mounting bracket end attached to the floor;

a controller tower, capable of moving to a first position and a second position, the controller tower having a first controller tower end and a second controller tower end, the first controller tower end pivotally mounted to the second mounting bracket end;

a controller assembly physically constrained at the second controller tower end; and a resistive element having a first element end and a second element end, the resistive element being strategically mounted to the controller tower to provide a toggle effect as the controller tower is moved between the first position and the second position, wherein the resistive element is a compressive element and wherein the controller tower moves through an intermediate position as it moves between the first position and the second position, the compressive element providing substantially no resistance to the movement of the controller tower at the intermediate position.

28. A method of positioning a controller for a work vehicle, the work vehicle having a dual position swivel seat capable of moving between a first swivel seat position and a second swivel seat position, a frame, a floor and a controller positioning system, the controller positioning system comprising a mounting bracket having a first mounting bracket end and a second mounting bracket end, the first mounting bracket end rigidly attached to the floor; a controller tower, the controller tower capable of moving to a first controller tower position and a second controller tower position, the controller tower having a first controller tower end and a second controller tower end, the first controller tower end pivotally mounted to the mounting bracket; a controller attached to the second controller tower end, an armrest attached to the second controller tower end; and a resistive element having a first element end and a second element end, the resistive element strategically mounted to the controller tower and the mounting bracket to provide a toggle effect as the controller tower is moved between the first position and the second position, the resistive element providing a resistance to a movement of the controller tower, the method including:

applying a directional load to the controller tower from one of the first controller tower position and the second controller tower position toward another of the first controller tower position and the second controller tower position, the directional load being sufficient to overcome the resistance from the resistive element and to move the controller tower toward the other of the first controller tower position and the second controller tower position;

maintaining the directional load until the resistive element biases the controller tower toward the other one of the first controller tower position and the second controller tower position, wherein the resistance from the resistive element to a movement away from the one of the first controller tower position and the second controller tower position decreases between the one of the first controller tower position and the second controller tower position and an intermediate position located between the first controller tower position and the second controller tower position and, wherein the resistive element biases a movement away from the intermediate position toward either the first controller tower position or the second controller tower position.

29. A method of positioning a controller for a work vehicle, the work vehicle having a dual position swivel seat capable of moving between a first swivel seat position and a second swivel seat position, a frame, a floor and a controller positioning system, the controller positioning system comprising a mounting bracket having a first mounting bracket end and a second mounting bracket end, the first mounting bracket end rigidly attached to the floor; a controller tower, the controller tower capable of moving to a first controller tower position and a second controller tower position, the controller tower having a first controller tower end and a second controller tower end, the first controller tower end pivotally mounted to the mounting bracket; a controller attached to the second controller tower end, an armrest attached to the second controller tower end; and a resistive element having a first element end and a second element end, the resistive element strategically mounted to the controller tower and the mounting bracket to provide a toggle effect as the controller tower is moved between the first position and the second position, the resistive element providing a resistance to a movement of the controller tower, the method including:

applying a directional load to the controller tower from one of the first controller tower position and the second controller tower position toward another of the first controller tower position and the second controller tower position, the directional load being sufficient to overcome the resistance from the resistive element and to move the controller tower toward the other of the first controller tower position and the second controller tower position;

maintaining the directional load until the resistive element biases the controller tower toward the other one of the first controller tower position and the second controller tower position, wherein the controller tower moves through an intermediate position as it moves between the first position and the second position, the resistive element providing substantially no resistance to the movement of the controller tower at the intermediate position.

* * * * *